United States Patent [19]

Yano et al.

[11] Patent Number: 5,022,439

[45] Date of Patent: Jun. 11, 1991

[54] CLOTH ROLLER REPLACING SYSTEM FOR LOOM

[75] Inventors: Tadashi Yano, Tokorozawa; Takatsugu Kato, Tokyo, all of Japan

[73] Assignee: Nissan Motor Co., Ltd., Yokohama, Japan

[21] Appl. No.: 359,789

[22] Filed: Jun. 1, 1989

[30] Foreign Application Priority Data

Jul. 20, 1988 [JP] Japan ..... 63-180838
Feb. 10, 1989 [JP] Japan ..... 1-14061[U]

[51] Int. Cl.[5] ..... D03D 49/20

[52] U.S. Cl. ..... 139/1 R; 242/68.1; 242/68.4; 414/911

[58] Field of Search ..... 414/911; 28/201; 242/1 R, 68, 67.3 R, 68.1, 68.3, 68.4, 66, 55; 139/304, 307, 308, 316

[56] References Cited

U.S. PATENT DOCUMENTS

| | | | |
|---|---|---|---|
| 2,714,404 | 8/1955 | Cadorette et al. | 139/304 |
| 2,746,489 | 5/1956 | Rogers | 139/304 |
| 2,800,288 | 7/1957 | Bandy | 242/68.4 X |
| 4,458,851 | 7/1984 | Tokuno et al. | 242/68.4 X |
| 4,606,381 | 8/1986 | Suwa et al. | 139/1 R |
| 4,664,332 | 5/1987 | Barazone | 242/68.4 X |
| 4,676,449 | 6/1947 | Buttermann | 242/68.4 |

FOREIGN PATENT DOCUMENTS

| | | | |
|---|---|---|---|
| 2628788 | 3/1978 | Fed. Rep. of Germany | 242/68.4 |
| 3213203 | 10/1983 | Fed. Rep. of Germany | 28/201 |
| 61-171956 | 9/1985 | Japan . | |
| 61-23060 | 1/1986 | Japan . | |
| 62-23061 | 1/1986 | Japan . | |

*Primary Examiner*—Andrew M. Falik
*Attorney, Agent, or Firm*—Foley & Lardner

[57] ABSTRACT

A system for replacing a filled cloth roller with an empty cloth roller for a loom is comprised of two rotatable shafts which are oppositely disposed and respectively supported by side frames of the loom. Each rotatable shaft is fixedly provided with an engaging member engageable with an end section of the cloth roller. The two rotatable shafts are automatically driven to move axially under the action of a pneumatically operated actuator, so that the engaging members are disengaged respectively from the opposite end sections of the cloth roller for the purpose of removing the filled cloth roller from the loom while engaged respectively with the same end sections for the purpose of installing the empty cloth roller to the loom. One of the rotatable shafts is driven from a loom main shaft to rotate the cloth roller, thus taking up a woven cloth on the cloth roller during the weaving operation of the loom.

24 Claims, 8 Drawing Sheets

CLOTH ROLLER REPLACING SYSTEM FOR LOOM

BACKGROUND OF THE INVENTION

1. Field of the Invention

This invention relates to a system for replacing a cloth roller with another one in a loom, and more particularly to a device for automatically removing a cloth roller on which a predetermined amount of a woven cloth has been wound to be replaced with an empty cloth roller.

2. Description of the Prior Art

Hitherto a mechanism for allowing a cloth roller to be removed from a loom has been proposed and put into practical use as disclosed in Japanese Patent Provisional Publication No. 61-23061. This mechanism is effective for replacing the cloth roller filled with a wound woven cloth with an empty or new cloth roller. In this mechanism, one end shaft section of the cloth roller is engaged with a rotatable drive shaft which is driven from a loom main shaft under frictional force transmission, while the other end shaft section is rotatably supported by a stationary member. Accordingly, the cloth roller is driven to rotate under rotation of the rotatable drive shaft.

Although the rotatable drive shaft is rotatably supported relative to a loom frame, it cannot be axially moved. Consequently in order to set the cloth roller in position in the loom, the end shaft section of the cloth roller is fitted with the rotatable drive shaft, and thereafter a cylindrical coupling member is used to commonly surround them. In order to remove the cloth roller from the loom, the cylindrical coupling is axially slidably moved out of the engaging section thereby disconnecting the cloth roller end shaft section from the rotatable drive shaft.

Thus, during installing and removal of the cloth roller, troublesome operations such as moving the coupling member and fitting the cloth roller end shaft section to the groove of the rotatable drive shaft are required. Such troublesome operations are carried out manually by an operator, thereby lowering operational efficiency in weaving a cloth.

SUMMARY OF THE INVENTION

It is an object of the present invention to provide an improved cloth roller replacing system which enables removal and installing operation for a cloth roller to be automatically carried out, thereby improving operational efficiency of a loom.

Another object of the present invention is to provide an improved cloth roller replacing system in which rotatable shafts for supporting a cloth roller are automatically axially movable toward and away from the cloth roller, thereby omitting troublesome manual operations required in conventional looms.

A cloth roller replacing system for a loom of the present invention is comprised of a rotatable shaft whose axis is generally aligned with the axis of the cloth roller. An engaging member is coaxially fixedly connected to an end section of the rotatable shaft and engageable with an end section of the cloth roller. Additionally, an actuator is provided to axially move the rotatable shaft so that the engaging member is selectively engaged with and disengaged from the cloth roller end section.

Accordingly, under the action of the actuator, the engaging member is engaged with the end section of the cloth roller for the purpose of rotationally driving the cloth roller, while disengaged from the end section of the cloth roller for the purpose of automatically removing the cloth roller from the loom without requiring troublesome manual operations.

BRIEF DESCRIPTION OF THE DRAWINGS

In the drawings, like reference numerals designate like elements and parts throughout all figures in which.

DETAILED DESCRIPTION OF THE INVENTION

Figure 1:
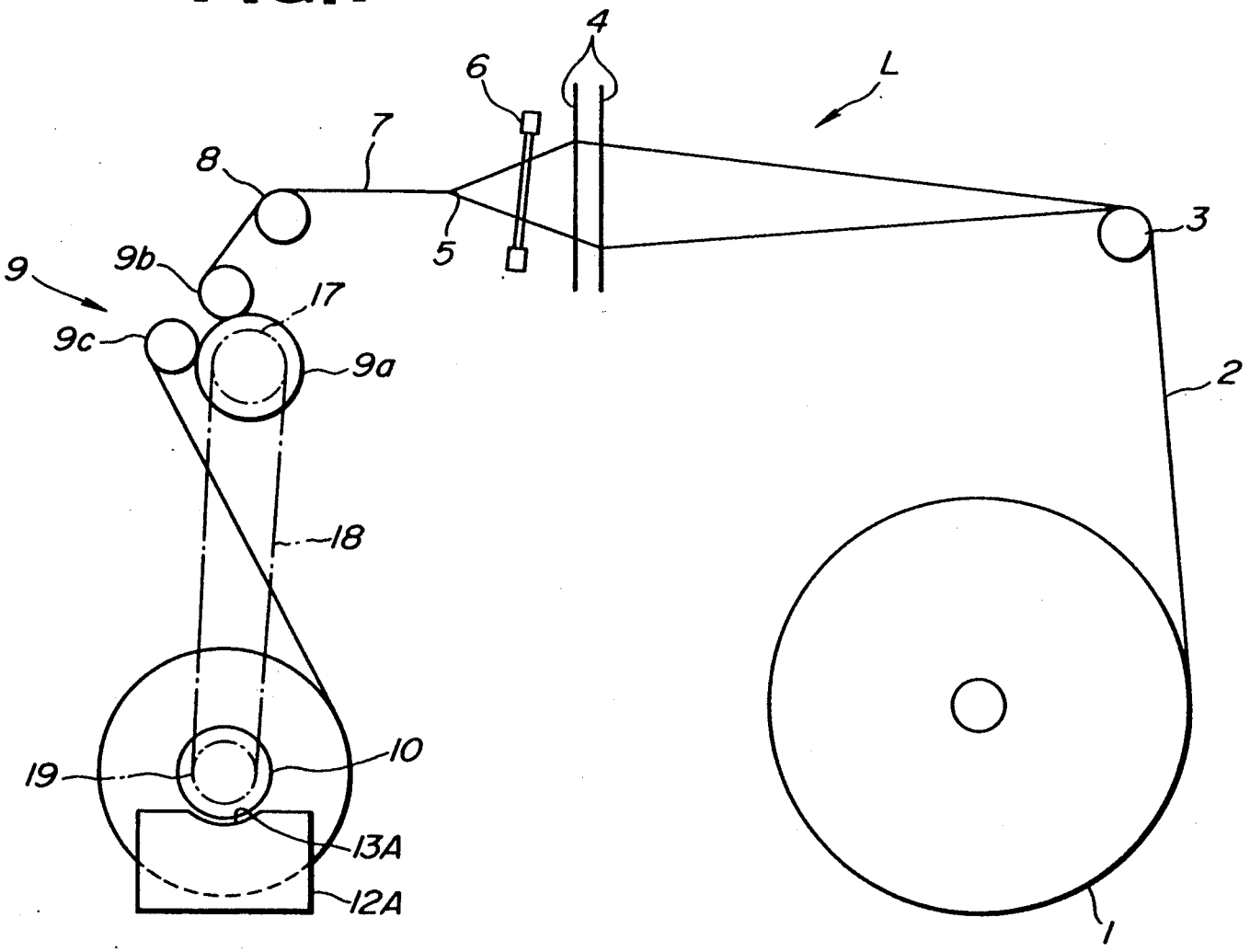
FIG. 1 is a schematic illustration of an essential part of a loom forming part of an embodiment of a cloth roller replacing system in accordance with the present invention.
Figure 2:
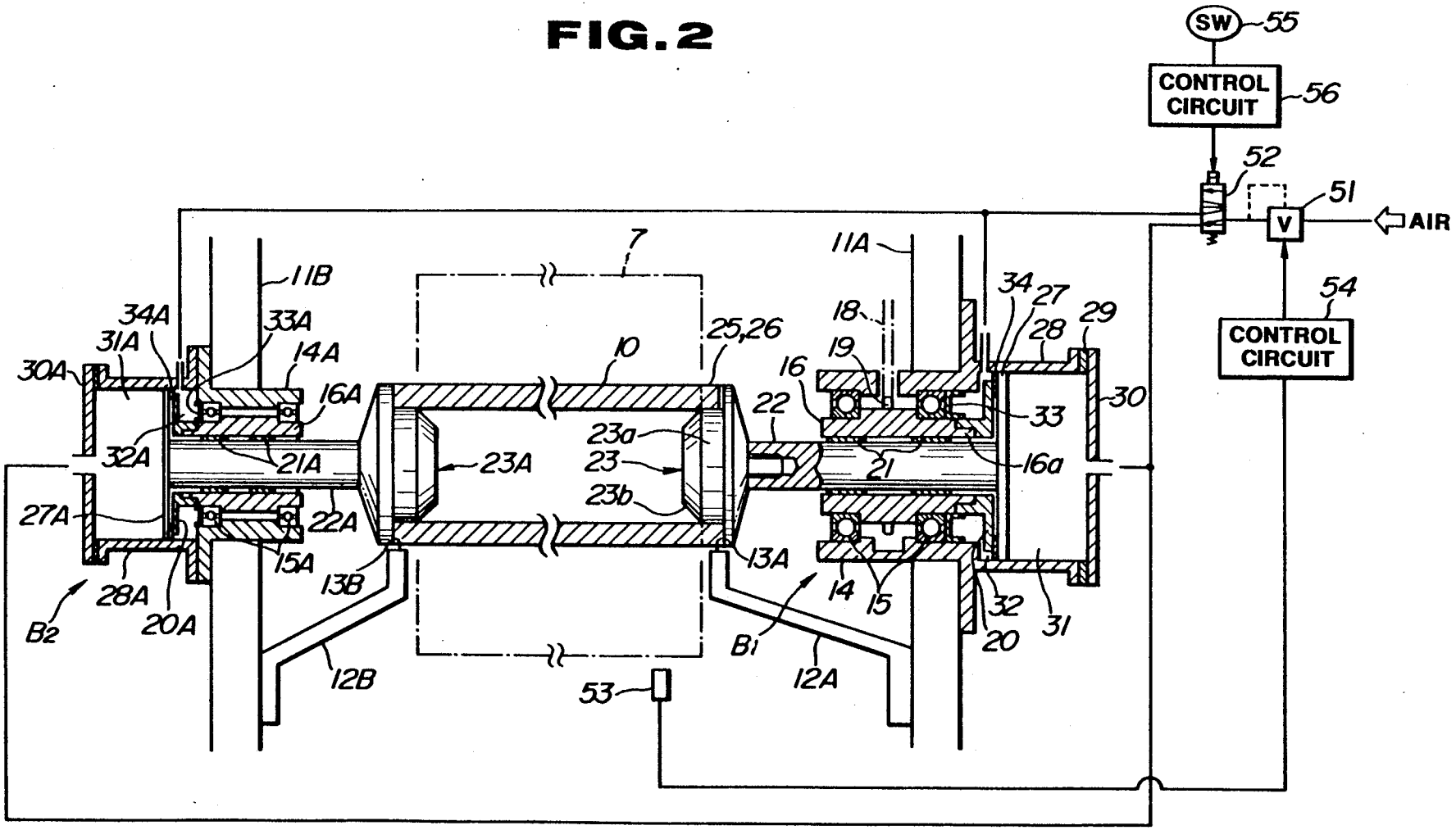
FIG. 2 is a longitudinal cross-sectional view of an essential part of the cloth roller replacing system of FIG. 1.
Figure 3:
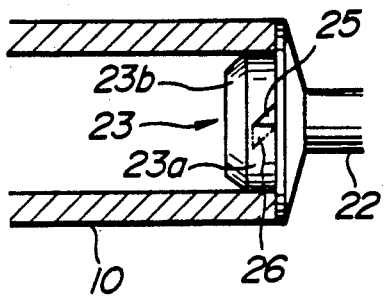
FIG. 3 is a fragmentary sectional view of a part of the system of FIG. 2.
Figure 4:
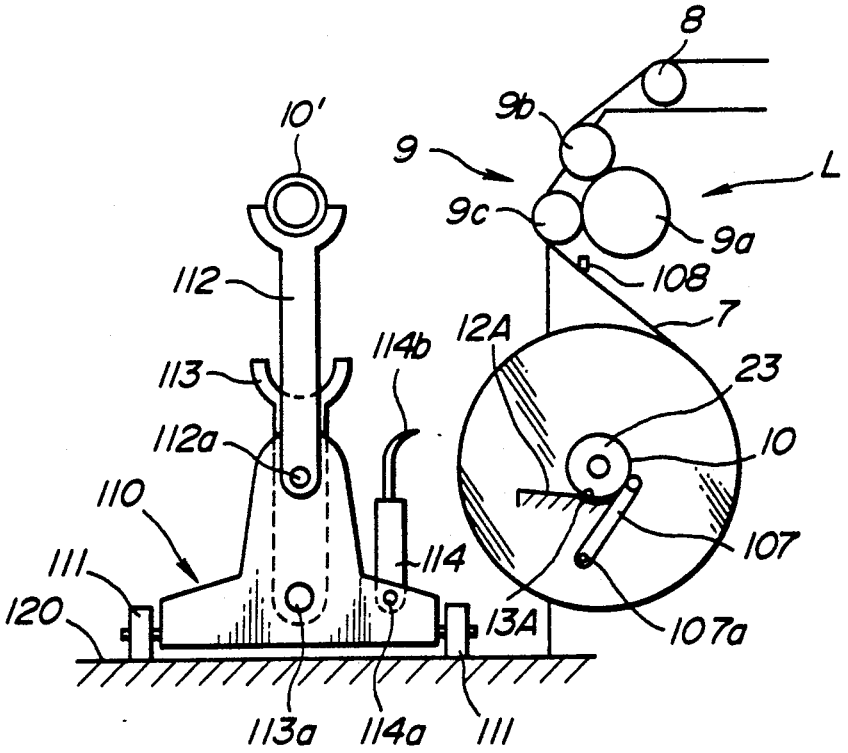
FIG. 4 is a schematic side view of the cloth roller replacing system shown in FIGS. 1 to 3.

Referring now to FIG. 1 to 3 of the drawings, an embodiment of a cloth roller replacing system according to the present invention is shown incorporated with a loom as illustrated in FIG. 1. In the loom L, warp yarns 2 wound on a warp beam 1 are passed on a back roller 3 to be guided to healds 4 which perform a shedding operation of the warp yarns 2 to form a shed opening. A weft yarn (not shown) is picked into the shed opening and beaten up by a reed 6 to accomplish weaving operation, thus weaving a cloth 7.

The thus woven cloth 7 is passed on a breast beam 8 to be guided to a filling density regulating device 9. The filling density regulating device 9 includes a surface roller **9*a* which is driven by a main shaft of the loom. A variety of moving parts of the loom are driven by and in timed relation to the main shaft. Otherwise, the surface roller 9*a* may be driven by other driving devices such as a servomotor rotating in timed relation to the loom main shaft. Two press rollers 9*b*, 9*c* are in press contact with the surface of the surface roller 9*a*. The woven cloth 7 from the breast roller 7 is passed through between the surface roller 9*a* and each press roller 9*b*, 9*c*, and thereafter taken or rolled up on a cloth roller 10. The cloth roller 10 is driven by a driving system shown in FIG. 2. The cloth roller 10** is removed after a predetermined amount of the woven cloth is taken or wound up on it, and replaced with a new cloth roller.

The cloth roller replacing system incorporated with the driving system will be discussed hereinafter mainly with reference to FIG. 2.

The cloth roller is cylindrical and mounted on support brackets 12A, 12B at the mounting grooves 13A, 13B as best shown in FIG. 1. The support brackets 12A, 12B are fixedly secured respectively to oppositely disposed side frames 11A, 11B of the loom. A cylindrical bearing and actuator structure $B_1$ is fixedly mounted on the side frame 11A and includes two rolling (ball) bearings 15 which are coaxial with and separate from each other. The rolling bearings 15 are mounted on a cylindrical movable member 16 which is driven to rotate from the surface roller 9*a*. More specifically, the movable member 16 is provided on its outer peripheral surface with a sprocket wheel 19 which is drivably connected through a chain 18 with a sprocket wheel 17 coaxially fixedly secured to the surface roller 9*a*. A first radially outwardly extending flange member 20 is coaxially fixedly secured to the movable member 16 at one end section 16*a* so as to be rotatable together with the movable member 16 as a one-piece member.

A rotatable shaft 22 is rotatably and axially movably disposed within the bore of the movable member 16 in such a manner as to be supported on the inner surface of the movable member 16 through bearings 21. An engaging member 23 is coaxially fixedly secured to one end section (on the side of the cloth roller 10) of the rotatable shaft 22. More specifically, the engaging member 23 has an axially extending shaft (no numeral) screwed in the movable shaft 22. The engaging member 23 has an axially extending cylindrical section 23*a* which is fittable into the bore in the cylindrical cloth roller 10 in such a manner as to be contactable with the inner surface of the cloth roller 10 at an end section on the side of the movable member 16. A generally frustoconical tapered section 23*b* is integrally formed on the free end of the cylindrical section 23*a*. The cylindrical section 23*a* is provided at its outer peripheral surface with a wedge-shaped piece 25 for rotation transmission, which piece 25 is engageable in a rotational direction with a projection 26 formed on the inner surface of the cloth roller 10 at the end section on the side of the movable member 16 as clearly shown in FIG. 3, so that rotation of the engaging member 23 is transmitted to the cloth roller 10.

A radially outwardly extending disc-shaped flange 27 is fixedly secured to the other end section opposite to the end section having the engaging member 23. The flange 27 is slidably movably fitted inside a cylindrical casing 28 which is formed integral with a cylindrical stationary member 14 fixedly secured to the loom side frame 11A. The cylindrical stationary member 14 is coaxially mounted on the roller bearings 15 so that the movable member 16 is rotatable relative to the stationary member 14. The peripheral surface of the flange 27 is in slidable contact with the inner surface of the casing 28. A lid disc 30 is provided to close the open end of the casing 28 in such a manner as to be fixed through a gasket 29 to the open end of the casing 28. Accordingly, a first air chamber 31 is defined between the flange 27 and the lid disc 30 and within the casing 28. Additionally, a second air chamber 32 is defined on the opposite side of the first air chamber 31 with respect to the flange 27. In this embodiment, the second air chamber 32 is formed within the casing 28 and communicates with an annular space (no numeral) defined between the movable member 16 and the stationary member 14 of the bearing and actuator structure $B_1$ through a clearance (no numeral) formed between the periphery of the flange member 20 and the inner peripheral surface of the casing 28. In this connection, an annular air-tight seal member 33 is provided on the side of one of the roller bearings 15 to maintain air-tight seal of the space defined between the stationary and movable members 14, 16.

A clutch pad 34 is fixedly secured onto the peripheral section of the flange 27 on the side of the second air chamber 32, and faces the flange member 20 so as to be slidably contactable with the surface of the flange member 20 thereby forming part of a friction clutch between the flange member 20 and the flange 27.

Another bearing and actuator structure $B_2$ is provided on the side of the loom side frame 11B and constructed similar to the bearing and actuator structure $B_1$ with the exception that a mechanism through which driving force is transmitted from the loom main shaft is omitted. Accordingly, the detailed explanation of the bearing and actuator structure $B_2$ is omitted for the purpose of simplicity of illustration by designating elements and parts corresponding to those in the bearing and actuator structure $B_1$ with the same reference numerals (for the first bearing structure $B_2$) affixing "A".

The first air chambers 31, 31A of the bearing and actuator structures $B_1$, $B_2$ are communicable with a pressurized air source (not shown) through an electricity-air pressure proportional valve 51 and an electromagnetically operated valve 52 which has two operational positions and four ports through which air passes. Accordingly, the first air chambers 31, 31A are controllably suppliable with pressurized air from the pressurized air source. The electricity-air pressure proportional valve 51 is electrically connected to a control circuit 54 which is in turn electrically connected to a winding diameter detector 53 for detecting the diameter of the woven cloth wound on the cloth roller 10 and producing a signal representative of the diameter. The control circuit 54 is adapted to control the electricity-air pressure proportional valve 51 in response to the signal from the winding diameter detector 53 in order to set an air pressure supplied to the first chambers 31, 31A through the valve 51 in such a manner as to regulate the torque transmitted from the flange 27(27A) to the flange member 20(20A) to a predetermined level. The electromagnetically operated valve 52 is controlled to take the two positions under the action of a control circuit 56 to which a signal from a switch 55 is input. It will be understood that an actuator (not identified) for the rotatable shaft 22(22A) is constituted by the first air chamber 31(31A), the second air chamber 32(32B) and the electromagnetically operated valve 52.

The manner of operation of the first embodiment cloth roller replacing system will be discussed hereinafter.

When the electromagnetically operated valve 52 is changed from a first position shown in FIG. 2 to a second position upon operating the switch 55 under a condition in which no cloth roller is set, pressurized air is supplied to the second air chambers 32, 32A so that the rotatable shafts 22, 22A move backward or in the direction away from each other. Then, an empty cloth roller (no woven cloth is wound) 10 is mounted on the support brackets 12A, 12B at the mounting grooves 13A, 13B of the support brackets 12A, 12B in such a manner that the axis of the cloth roller 10 is brought generally into alignment with the axes of the rotatable shafts 22, 22A.

Subsequently, the electromagnetically operated valve 52 is changed from its second position to the first position as shown in FIG. 2, so that pressurized air is supplied to the first air chambers 31, 31A. Then, the flanges 27, 27A move forward or in the direction of the cloth roller 10, and therefore, the engaging members 23, 23A are respectively brought into engagement with the opposite end sections of the cloth roller 10. Accordingly, the cylindrical section 23*a* of each engaging member 23 is brought into fitting contact with the inner peripheral surface of the cloth roller 10 upon being guided by the tapered section 23*b*, in which the cloth roller 10 is slightly lifted from the surface of the mounting grooves 13A, 13B of the support brackets 12A, 12B. Additionally, the wedge-shaped piece 25 of the rotatable shaft 22 is brought into engagement with the projection 26 of the cloth roller 10. At this time, the flange 27 is brought into frictional contact with the flange member 20 through the clutch pad 34.

Under this state, the loom is operated to weave the cloth in which the rotatable member 16 is rotating upon being driven from the loom main shaft. The rotation of the movable member 16 is transmitted from the flange member 20 to the flange 27 through the clutch pad 34, and therefore, the rotatable shaft 22 is rotated, thereby driving the cloth roller 10 to rotate. It will be understood that the rotational force transmitted to the flange 27 is proportional to pressure for biasing the flange 27 onto the flange member 20, so that the transmitted rotational force (i.e., tension of the woven cloth wound on the cloth roller 10) can be controlled in accordance with air pressure to be supplied to the first air chambers 31, 31A. Thus, by controlling the air pressure to be supplied to the first air chambers 31, 31A in response to the signal output from the winding diameter detector 53, a torque for the cloth roller 10, suitable for the diameter of the woven cloth wound on the cloth roller 10, can be obtained thereby enabling the system to keep the tension of the woven cloth to be wound on the cloth roller 10 constant.

In order to remove the cloth roller 10 after a predetermined amount of the woven cloth has been wound, the electromagnetically operated valve 52 is changed from the first position (shown in FIG. 2) to the second position so that pressurized air is supplied into the second air chambers 32, 32A. Accordingly, the rotatable shafts 22, 22A are moved backward or in the direction away from the cloth roller 10, thereby releasing the engagement of the engaging members 23, 23A from the end sections of the cloth roller 10. Thus, transmission of rotational driving force from the flange 27 to the flange member 20 is interrupted. Thereafter, a further backward movement of the rotatable shafts 22, 22A is made so that the engaging members 23, 23A are separate from the end sections of the cloth roller 10. Accordingly, the cloth roller 10 is put on the support brackets 12A, 12B at the mounting grooves 13A, 13B. Thereafter, the cloth roller 10 is removed out of the system and will be replaced with the empty cloth roller (not shown).

FIGS. 4 to 8 illustrate an example of a device for removing a filled cloth roller (a predetermined amount of a woven cloth is wound) 10 from the loom L and installing the empty cloth roller 10'. The device is used in combination with the loom shown in FIGS. 1 to 3 and forms part of the cloth roller replacing system of the present invention. The device includes a movable carrier 110 provided with wheels 111. The carrier 110 is provided with upper support arms 112 for supporting the empty cloth roller 10' and lower support arms 113 for supporting the filled cloth roller 10. Each upper support arm 112 is pivotally movable around a pivot shaft 112*a*. Each lower support arm 113 is pivotally movable around a pivot shaft 113*a*. Additionally, cloth winding arms 114 are provided in the carrier 110 in such a manner as to be pivotally movable around pivot shafts 114*a*. In this embodiment, the mounting surface of the support brackets 12A(12B) inclines as shown, in which the cloth roller 10 can roll and move upwardly on the inclining mounting surface upon being pushed by a push rod 107 which is pivotally movable around a pivot axis 107*a*. A cutter 108 is provided in the loom in order to cut the woven cloth 7 in a position between the press roller 9*c* and the cloth roller 10.

A manner of replacing the filled cloth roller with the empty cloth roller is summarized into the following four steps:

1st step: The carrier 110 carrying the empty cloth roller 10' is stopped in front of the loom L.

2nd step: The woven cloth 7 is cut in a position between the press roller 9*c* and the cloth roller 10.

3rd step: The filled cloth roller 10 is transferred from the loom L to the carrier 110, while the empty cloth roller 10' is transferred from the carrier 110 to the loom L.

4th step: The cut end section 7*a* of the woven cloth 7 is wound on the empty cloth roller 10' by the winding arm 14.

The above-four steps will be discussed in detail hereinafter with reference to FIGS. 4 to 8.

The 1st step (See FIG. 4):

During weaving operation of the loom L, the woven cloth 7 is being wound on the cloth roller 10 through the breast beam 8, the surface roller 9*a* and the press rollers 9*b*, 9*c*. In a stock station (not shown), the empty cloth roller 10' is put on the support section (no numeral) of the upper support arm 12 so that the carrier 110 carries the empty cloth roller 10'.

In a process of loom weaving operation, immediately before the amount of the woven cloth 7 wound on the cloth roller 10 reaches a predetermined level, the carrier 110 which carries the empty cloth roller 10' and stands ready in the stock station (not shown) moves on a floor 120 under rotation of the wheels 111 in response to a signal output from a control circuit (not shown) mounted on the loom L, and stops in front of and spaced from the loom L.

The 2nd step (See FIG. 5):

When the amount of the woven cloth wound on the cloth roller 10 reaches the predetermined level, the cutter 108 is moved in the direction of width of the woven cloth 7 making its cutting action thus cutting the woven cloth 7 in the position between the press roller 9*c* and the cloth roller 10. The weaving operation of the loom L continues during and after this cutting operation, and therefore the cut end section 7*a* of the woven cloth 7 hangs down from the press roller 9*c* toward the cloth roller 10.

Figure 5:
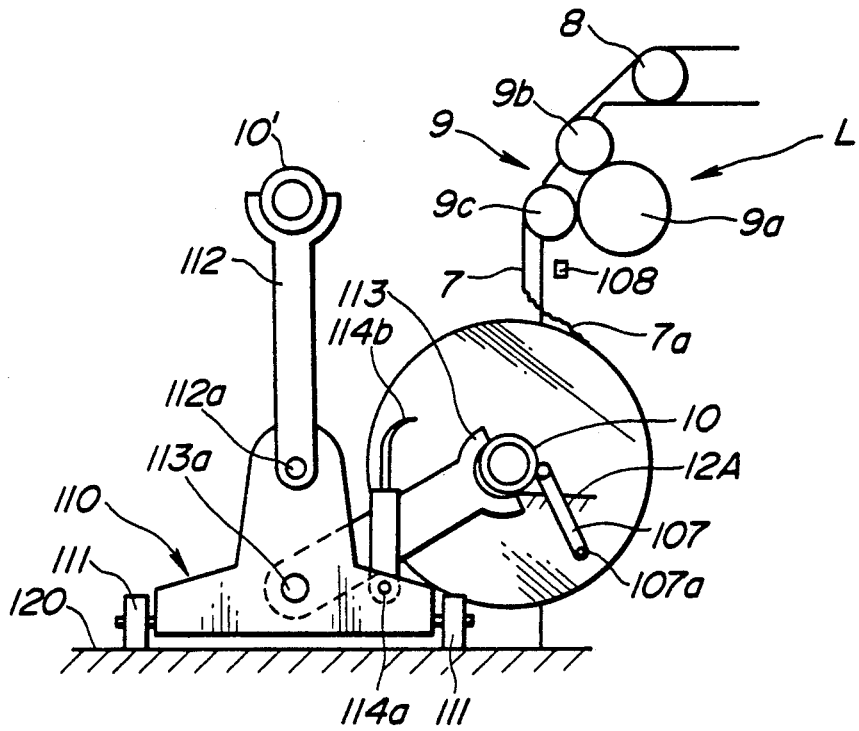
FIGS. 5 to 8 are schematic side views similar to FIG. 4 but illustrating various operational states of the cloth roller replacing system.

The 3rd step (See FIGS. 5 to 7):

First as shown in FIG. 5, the clutch mechanism (including the integers 20, 27 in FIG. 2) is released to interrupt transmission of driving force from the movable member 16 to the rotatable shaft 22, thereby stopping rotational movement of the cloth roller 10. Subsequently, each lower support arm 113 is pivotally moved toward the loom L around the pivot shaft 113*a* and stopped at a position near the inclining mounting surface of the support brackets 12A, 12B to stand ready as it is. Then, the push lever 107 is rotationally moved toward the carrier 110 around the pivot axis 107*a*, thereby pushing up the filled cloth roller 10 along the inclining mounting surface of the support brackets 12A, 12B. As a result, the filled cloth roller 10 is put on the support sections of the lower support arms 113 which is standing ready at a predetermined position.

Figure 6:
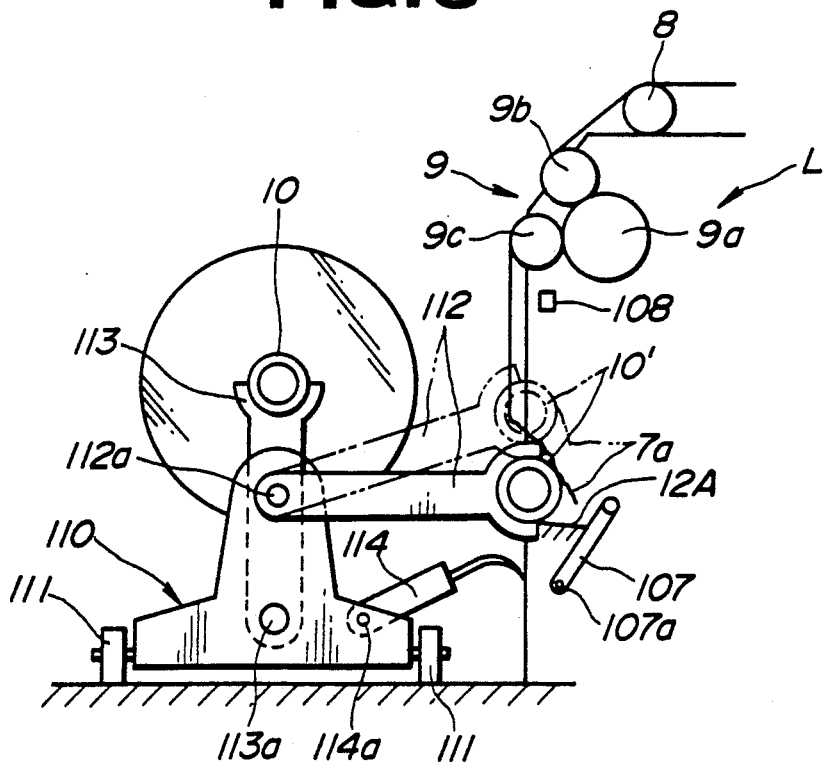
Figure 7:
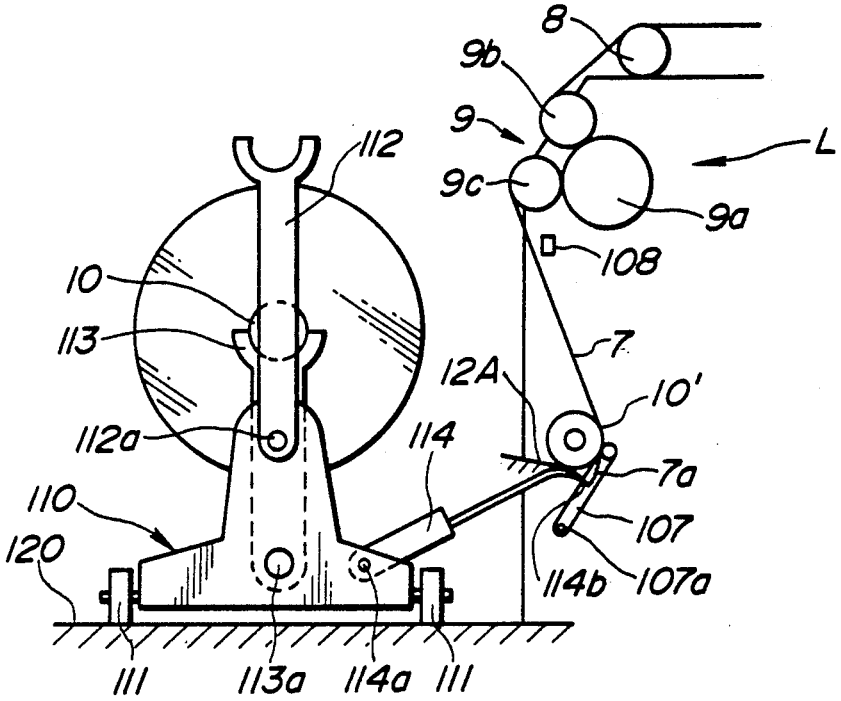

Subsequently as shown in FIG. 6, the push lever 107 is rotationally moved to the lower end side of the inclining mounting surface of the support brackets 12A, 12B and restored to its original position to be stopped, while each lower support arm 113 carrying the filled cloth roller 10 is restored to the mounting position in the carrier 110 to be stopped at its position. Then, each upper support arm 112 carrying the empty cloth roller 10' is rotationally moved to the side of the loom L around the pivot shaft 112*a* and so stopped that the upper end thereof comes near the upper end of the inclining mounting surface of the support brackets 12A, 12B. In this instance, the rotational movement and the stopping of the upper support arm 112 carrying the empty cloth roller 10' is so controlled that the empty cloth roller 10' being mounted on the loom L pushes rearward the woven cloth 7 which is continued to be woven after cutting and is hanging down from the press roller 9*c* as shown in FIG. 6, in accordance with a weaving speed which is calculated from the revolution speed (or the rotational speed of the main shaft) of the loom and filling (weft yarn) density. Then the rotational movement of the upper support arm 112 is stopped so that the opposite end sections of the empty cloth roller 10' are mounted on the inclining mounting surface of the support brackets 12A, 12B, the empty cloth roller 10' rolls down and stops at the mounting grooves 13A, 13B at the lower end sections of the inclining mounting surface of the support brackets 12A, 12B as shown in FIG. 7. Thereafter, the engaging members 23, 23A are brought into engagement with the opposite end sections of the empty cloth roller 10' under action of the actuator (including the numerals 22, 22A, 27 and 27A in FIG. 2). Then the above-mentioned clutch mechanism (including the numerals 20, 27 in FIG. 2) is engaged to mechanically connect the rotatable shaft 22 with the rotatable member 16 driven from the loom main shaft, so that the empty cloth roller 10' is driven to rotate. The upper support arm 112 for the empty cloth roller 10' is restored to its original position and stopped after the empty cloth roller 10' is moved onto the support brackets 12A, 12B.

The 4th step (See FIGS. 7 and 8):

First as shown in FIG. 7, the winding arm 114 is rotationally moved to the side of the loom L around the pivot axis 114*a* and makes its extension action so that its tip end section 114*b* moves to a position near and below the empty cloth roller 10' located at the lower end section of the inclining mounting surfaces of the support brackets 12A, 12B. In this state, the tip end section 114*b* catches the cut end section 7*a* of the woven cloth 7.

Figure 8:
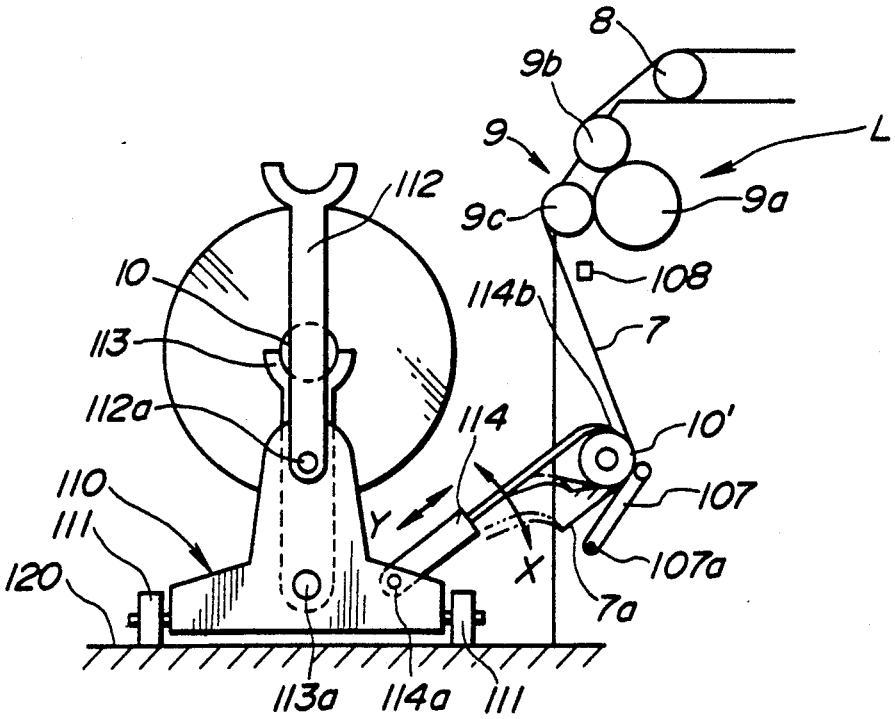

Consequently as shown in FIG. 8, when the woven cloth end part having the cut end section 7*a* caught by the winding arm 114*b* becomes sufficiently long to be wound one turn on the empty cloth beam 10' with proceeding of weaving operation of the loom, the winding arm 114 is rotationally moved in directions indicated by a two-headed arrow X and makes its extension and contraction actions in directions indicated by a two-headed arrow Y. Under combination of such rotational movements and such actions of the winding arm 114, the tip end section 114*b* of the winding arm 114 is moved from a position indicated by dash-dot line through a position indicated by dash-dot-dot line to a position indicated by solid line, in which the winding arm tip end section 114*b* generally turns around the empty cloth roller 10'. Then the winding arm tip end section 114*b* stops at a position where the woven cloth comes contact with the empty cloth roller 10' and operates to cause the woven cloth cut end section 7*a* to be brought into the position and to be inserted into between the woven cloth 7 and the empty cloth roller 10'. As a result, the woven cloth cut end section 7*a* is put between the woven cloth 7 and the empty cloth roller 10'. Thus, the cloth roller cut end section 7*a* is wound on the empty cloth roller 10'. Thereafter, the winding arm 114 is restored to and stopped at its original position, thus completing one cycle of replacing the filled cloth roller with the empty cloth roller.

The carrier 110 carrying the filled cloth roller 10 moves back to the stock station. When the woven cloth 7 in the room L is wound on the empty cloth roller 10' to accomplish a state in which the amount of the woven cloth wound on the cloth roller reaches the predetermined level with proceeding of the loom weaving operation, the operations at the above discussed 1st to 4th steps will be successively carried out.

Although only the winding arm 114 of the mechanically operated type has been shown and described as a device for catching and winding the woven cloth cut end section 7*a* on the empty cloth roller 10', it will be understood that the device may be of other mechanically operated types wherein the catching and winding actions for the cloth is made under grasping action, adhesion or suction. In case of using the suction, when the woven cloth cut end section (7*b*) is inserted into between the woven cloth (7) and the empty cloth roller 10', air is ejected from the tip end section of the device thereby to further securely accomplish the initial winding of the woven cloth onto the empty cloth roller 10'.

While only one winding arm 114 has been shown and described, it will be understood that a plurality of winding arms 114 may be arranged in the direction of width of the loom L.

Thus, by using the carrier 110 configurated as discussed above, the filled cloth roller can be automatically removed from the loom, while the empty cloth roller can be automatically mounted onto the loom, thereby further promoting automation and labor saving in loom weaving operation.

Figure 9:
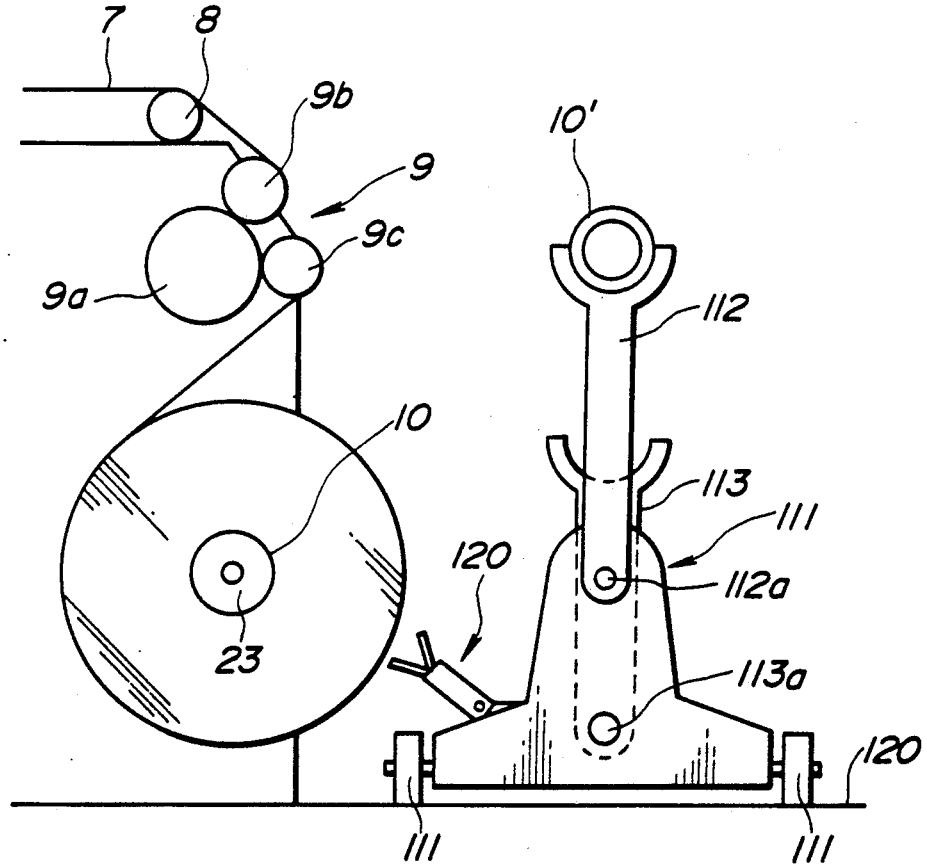
FIG. 9 is a schematic side view of another embodiment of the cloth roller replacing system in accordance with the present invention.
Figure 10A:
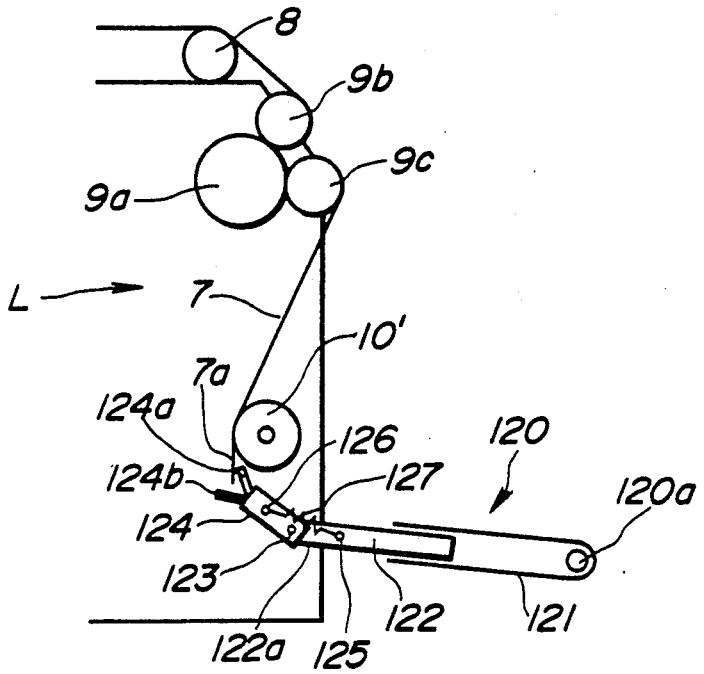
FIGS. 10A to 10C are fragmentary schematic illustrations of an essential part of the cloth roller replacing system of FIG. 9.
Figure 10B:
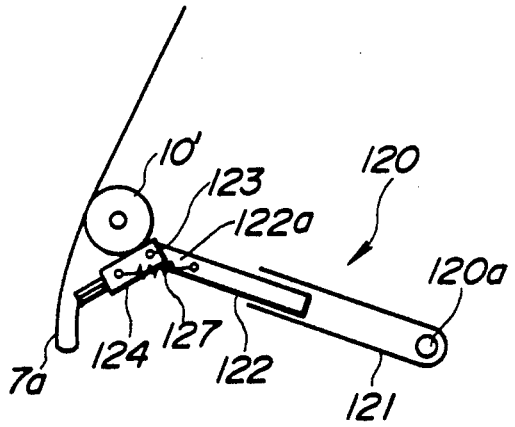
Figure 10C:
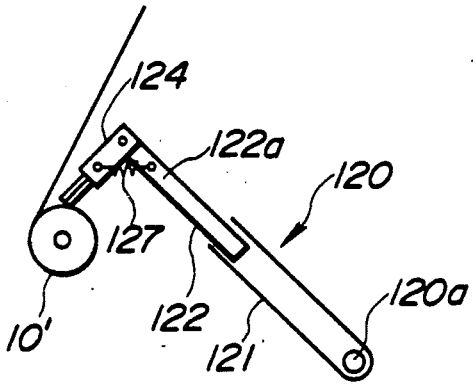

FIGS. 9 to 10*c* illustrate another embodiment of the cloth roller replacing system in accordance with the present invention, which is similar to that shown in FIGS. 1 to 8 with the exception that a winding mechanism 120 is used in place of the winding arm 114.

In this embodiment, the cloth roller removing and installing device includes the carrier 110 which can be controllably moved and stopped to a position in front of the loom L. The carrier 110 is provided with the upper support arm 112 and the lower support arm 113. The upper control arm 112 is adapted to rotationally move around the pivot shaft 112*a* under action of an air cylinder (not shown). The lower support arm 113 is adapted to rotationally move around the pivot shaft 113*a* under action of an air cylinder (not shown). The empty cloth roller 10' is mounted on the mounting section of the upper support arm 112. Additionally, the winding mechanism 120 is provided in the carrier 110 and adapted to rotationally move around the pivot axis 120*a* under action of a pulse motor (not shown).

In order to replace the filled cloth roller 10 with the empty cloth roller 10', the lower support arm 113 is rotationally moved around the pivot shaft 113*a* to thereby support the filled cloth roller 10 on the side of the loom L. Thereafter, the lower support arm 113 is rotationally moved in an opposite direction around the pivot shaft 113*a* to thereby take the filled cloth roller 10 out of the loom L. Subsequently, a cutter (not shown) is operated to cut the woven cloth 7 in a position between the press roller 9*c* and the filled cloth roller 10. Then, the upper support arm 112 is rotationally moved around the pivot shaft 112*a* to set the empty cloth roller 10' in position in the loom L. Thereafter the upper support arm 112 is rotationally moved in an opposite direction around the pivot shaft 112*a* while leaving the empty cloth roller 10' in the loom L. Thereafter, the woven cloth 7 is wound on the empty cloth roller 10' newly mounted on the loom L under the action of the winding mechanism 120 as clearly shown in FIGS. 10A to 10C in which only one winding mechanism is shown for the purpose of simplicity of illustration though there are, in fact, a plurality of winding mechanism 120 arranged in the direction of width of the loom L.

As shown in FIGS. 10A to 10C, the winding mechanism 120 includes a first arm or cylinder 121 which is pivotally fixed to the carrier 110 and rotationally moved around the pivot axis 120*a* under the action of a step motor (not shown). A second arm 122 is slidably movably disposed within the cylindrical first arm 121 so as to project from and withdraw within the first arm 121 by means of an air cylinder (not shown). The second arm 122 is provided at its free end or support section 122*a* with a pivot pin 123. A grasping device 124 for retaining the woven cloth end section 7*a* is movably connected through the pivot pin 123 to the free end section of the second arm 122 so as to be rotationally movable around the pivot pin 123. The grasping device 124 includes a pair of grasping pieces 124*a*, 124*b* which are moved to contact with and separate from each other to grasp and release the woven cloth. Additionally, a tension spring 127 is extended between a fixed pin 124 in the second arm 122 and a fixed pin 126 in the grasping member 124. The tension spring 127 is so arranged as to pass over the pivot pin 123 in a state in which the grasping member 124 is brought generally into alignment with the second arm 122. In other words, the grasping member 124 is rotationally biased in opposite directions around the pivot pin 123 with respect to the state in which a line connecting the centers of the fixed pin 124, the pivot pin 123 and the fixed pin 125 becomes straight. Thus, the tension spring 127 serves as a so-called overcenter spring.

With the above configurated winding mechanism 120, the end section 7*a* of the woven cloth 7 is wound on the empty cloth roller 10' newly mounted on the loom L as follows:

First as shown in FIG. 10A, the first arm 121 is inclined downward while projecting the second arm 122, so that the support section 122*a* at the tip end section of the second arm 122 is brought into a position below the cloth roller 10'. The grasping device 124 is previously rotationally moved upward around the pivot pin 123 upon bias of the extension spring 127 and engaged with a stopper (not shown), in which the grasping pieces 124*a*, 124*b* are separated from each other. In this state, the end section of the woven cloth 7 on the loom side is inserted between the grasping pieces 124*a*, 124*b* and then grasped by being put between the grasping pieces 124*a*, 124*b* which are contacted with each other.

Thereafter, since slackening of the woven cloth 7 is made to a some extent upon proceeding of the weaving operation, the first arm is inclined upwardly as shown in FIG. 10B so that the grasping device 124 is pressed against the empty cloth roller 10'. As a result, the grasping device 124 is rotationally moved around the pivot pin 123 to be brought into engagement with a stopper (not shown), so that the grasping device 124 is directed obliquely downward It will be understood that if the grasping device 124 has been once directed downward, it is maintained as it is under the action of the extension or overcenter spring 127.

Then, the first arm 122 is inclined upwardly during which the second arm 122 is once withdrawn and again projected, so that the supporting section 122*a* at the tip end section of the second arm 122 is turned around the peripheral surface of the cloth roller 10' to be located over the cloth roller 10' as shown in FIG. 10C. At this time, the grasping device 124 is directed obliquely downward and therefore the tip end portion of the grasping device 124 is directed to the peripheral surface of the cloth roller 10. Accordingly, the tip end portion of the grasping device 124 functions not only to wind up the woven cloth 7 onto the cloth roller 10' but also to insert the end section 7*a* of the woven cloth 7 in between the cloth roller 10' and the woven cloth 7.

Thus, the end section 7*a* of the woven cloth 7 is securely mechanically wound on the empty cloth roller 10'. Particularly under the action of changing the direction or swinging movement of the grasping device 124, the woven cloth end section 7*a* can be inserted in between the cloth roller 10' and the woven cloth 7, thereby accomplishing a further secure winding operation of the woven cloth on the cloth roller 10'. While the swinging movement of the grasping device 124 has been shown and described as being made by contacting the grasping device 124 with the cloth roller under action of the extension or overcenter spring, it will be understood that the swinging movement of the grasping device 124 may be made under action of an air cylinder or an electromagnet. After completion of the winding operation of the woven cloth 7 on the cloth roller 10', the grasping pieces 124*a*, 124*b* of the grasping device 124 is separate to release the woven cloth end section 7*a*. Then, the second arm 122 is withdrawn into the first arm 121 while the first arm 121 is returned to the side of the carrier 110.

Figure 11:
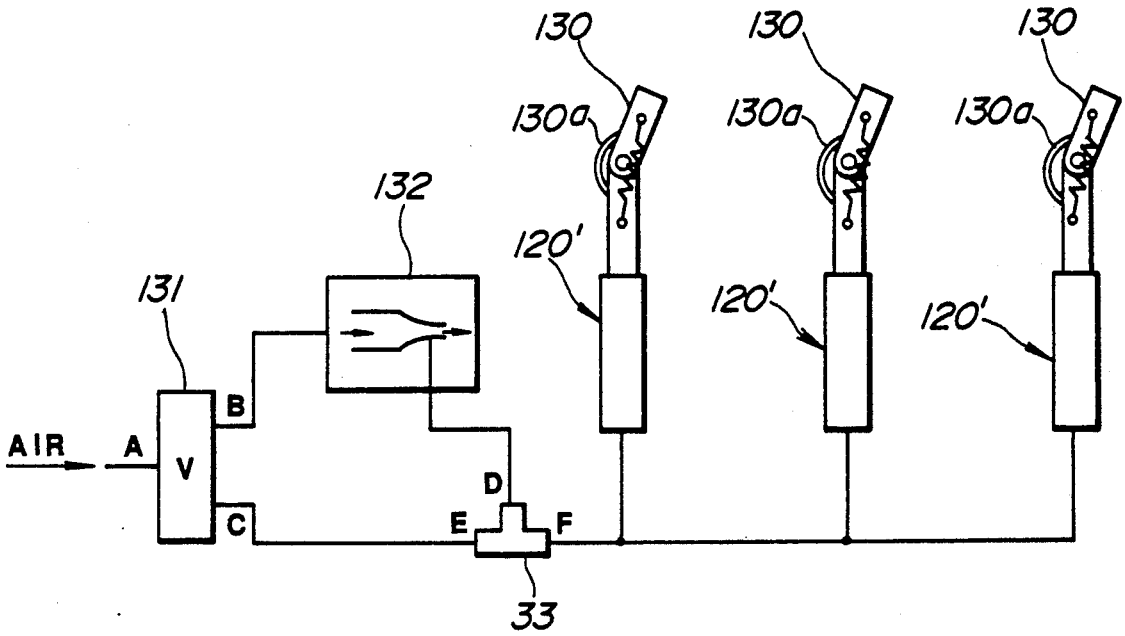
FIG. 11 is a schematic illustration of a modified example of the cloth roller replacing system of FIG. 9.

FIG. 11 shows another example of the winding mechanisms 120' each of which is similar to that shown in FIGS. 10A to 10C with the exception that an air pipe 130 formed at its tip end section with a slit is used in place of the grasping device 124. In this embodiment, vacuum and pressurized air is selectively introduced into each air pipe 130 through a connecting pipe 130*a* and the second arm 122 from the first arm 121.

Pressurized air from a pressurized air source (not shown) is introduced through a port A into a directional control valve 131 and fed through a port B into a vacuum generating device 132 (having an orifice section).

Vacuum generated in the device 132 is supplied through ports D and F of a three-way valve 133 to the first arm 121 of each winding mechanism 120'. Besides, pressurized air introduced into the directional control valve 131 is fed from a port C to a port E of the three-way valve 133 and introduced from the port F into the first arm 121 of each winding mechanism 120'. Accordingly, under changing action of the three-way valve 133, the air pipe 130 can be selectively supplied with vacuum and pressurized air.

The above arrangement including the winding mechanisms 120' operates as follows:

Before operation of each winding mechanism 120', the ports B and C are closed. In order to retain the woven cloth end section *7a*, vacuum is introduced to the air pipe 130 through the port A and B of the directional control valve 131, the vacuum generating device 132, the ports D and F of the three-way valve 133 in the mentioned order. Accordingly, vacuum prevails in the air pipe 130 thereby sucking the woven cloth end section *7a* to retain it at the tip end section of the air pipe 130. At this time, the port C of the directional control valve 131 and the port E of the three-way valve 133 are closed.

Thereafter, the air pipe 130 is moved around the cloth roller 10' corresponding to the weaving speed of the cloth 7. When the air pipe 130 reaches the final position for winding the woven cloth end section *7a*, the air pipe 130 is supplied with pressurized air in place of vacuum so that suction of the air pipe 130 is changed into air ejection. As a result, the woven cloth end section *7a* is inserted in between the woven cloth 7 and the cloth roller 10' thereby accomplishing a secure winding operation for the woven cloth end section *7a*. At this time, the pressurized air is introduced into the air pipe 130 through the ports A and C of the directional control valve 131 and the ports E and F of the three-way valve 133 in the mentioned order. At this time, the port B of the directional control valve 131 and the port D of the three-way valve 133 are closed.

Thus, according to the above arrangement, the end section of the woven cloth can be securely wound on the cloth roller. Additionally, completion of the winding operation for the woven cloth end section can be automatically detected by an arrangement which is incorporated with an example of a driving system for the cloth roller 10' as shown in FIG. 12.

Figure 12:
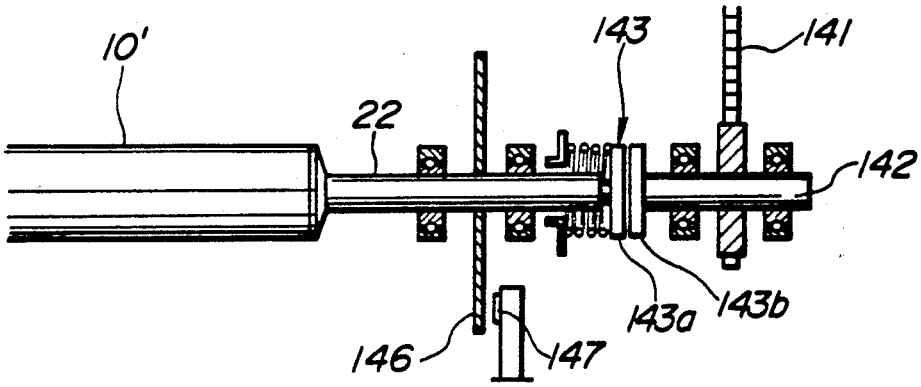
FIG. 12 is a fragmentary plan view partly in section of a driving system for a cloth roller, used in the cloth roller replacing system of FIGS. 9 to 11.

In the driving system in FIG. 12, a driving shaft 142 is driven through a chain 141 by a driving source (not shown) such as the loom main shaft. The driving shaft 142 is drivingly connectable through a friction clutch 143 with the rotatable shaft 22 so that the rotatable shaft 22 is driven to rotate thus to drive the cloth roller 10'. The friction clutch 143 is used to absorb the difference between the speeds of the driving shaft 142 and the cloth roller 10' upon sliding action between the two cluth discs 143*a*, 143*b*, which is required for the fact that the speed of the driving shaft 142 is higher than the speed of weaving the cloth so that the rotatable shaft 22 is forced to rotate at the cloth weaving speed in a state where the woven cloth is being taken up. This enables the woven cloth to be taken up under tension. Accordingly, the rotational speed of the cloth roller rises when no woven cloth is wound on the cloth roller, while it lowers when the winding operation for the cloth is completed. Thus, the completion of the cloth winding operation can be detected by such a change in rotational speed of the cloth roller 10' or the rotatable shaft 22.

In this connection, the signal disc plate 146 is fixedly mounted on the rotatable shaft 22 so as to rotate together with the rotatable shaft 22 as a one-piece member. The signal disc plate 146 is formed with a mark (not shown) such a slit or a projection. This mark is sensed by a sensor 147 which is adapted to output a signal corresponding to the mark. In accordance with this signal, the rotational speed of the signal disc plate 146 is detected by using a pulse counter (not shown), a rotary encoder (not shown) or the like, thus detecting a decreasing change of rotational speed of the cloth roller. As a result, the completion of winding the woven cloth on the cloth roller can be detected.

It will be appreciated that according to the arrangements of FIGS. 9 to 12, the winding mechanism 120, 120' is constructed and arranged to be rotatable around the cloth roller thereby making it possible to securely retain and wind the end section of the woven cloth around the cloth roller.

It will be also appreciated that, in the above discussed embodiments, movement or running of the carrier 110, operations of the upper and lower support arms 112, 113 and the winding arm 114 may be automatically controlled in response to signals which are output from a control circuit (not shown) mounted on the loom L in accordance with rotation of the loom main shaft and/or with a state (for example, completion) of winding the woven cloth on the cloth roller, though not shown.

What is claimed is:

1. In a loom, a system for replacing a cloth roller for said loom with another one, said system comprising:

a first rotatable shaft whose axis is generally aligned with an axis of said cloth roller;

a first engaging member fixedly connected to a first end section of said first rotatable shaft, said first engaging member being coaxial with said first rotatable shaft and engageable with a first end section of said cloth roller;

actuator means for axially moving said first rotatable shaft so that said first engaging member is selectively engaged with and disengaged from said cloth roller first end section;

a second rotatable shaft whose axis is generally aligned with the axis of said cloth roller, said second rotatable shaft being axially movable by said actuator means;

a second engaging member fixedly connected to a first end section of said second rotatable shaft, said second engaging member being coaxial with said second rotatable shaft and engageable with a second end section of said cloth roller, said second engaging member being selectively engaged with and disengaged from said cloth roller second end section upon axial movement of said second rotatable shaft; and means for rotatably driving said first rotatable shaft around an axis of said first rotatable shaft in a timed relation to an operation of the loom.

2. A system is claimed in claim 1, wherein said cloth roller is cylindrical, and wherein a free end section of said first engaging member is tapered to facilitate insertion of said first engaging member into said cloth roller, said tapered free end section being coaxial with said first rotatable shaft.

3. A system as claimed in claim 2, wherein said cloth roller has a cylindrical section located between said tapered free end section and said first rotatable shaft first end section, said cylindrical section being coaxial with said first rotatable shaft and fittable with the inner peripheral surface of said cylindrical cloth roller first end section.

4. A system as claimed in claim 3, further comprising coupling means for causing said cloth roller to rotate together with said first engaging members as a one-piece member.

5. A system as claimed in claim 4, wherein said coupling means includes a first projection formed on a peripheral surface of said first engaging member cylindrical section, and a second projection formed on an inner peripheral surface of said cylindrical cloth roller first end section, said second projection being engageable with said first projection in a direction of rotation of said first engaging member.

6. A system as claimed in claim 2, wherein said tapered free end section is generally frustoconical.

7. A system as claimed in claim 1, wherein said actuator means includes a plate piston member fixedly secured to a second end section of said first rotatable shaft, said plate piston member defining first and second fluid chambers on the opposite sides thereof, said first and second fluid chambers being selectively supplied with a fluid.

8. A system as claimed in claim 7, further comprising means for supporting said first shaft relative to a frame of the loom so as to be rotatable and axially movable.

9. A system as claimed in claim 8, wherein said supporting means includes an outer cylindrical member fixed to the loom frame, an inner cylindrical member coaxial with said first outer cylindrical member, said rotatable shaft being movably disposed in a bore of said inner cylindrical member, and a roller bearing disposed between said inner and outer cylindrical members to allow said inner cylindrical member to rotate relative to said outer cylindrical member.

10. A system as claimed in claim 9, further comprising means for driving said inner cylindrical member to rotate around said first rotatable shaft.

11. A system as claimed in claim 10, wherein said inner cylindrical member has a radially extending flange coaxial with said rotatable shaft, said flange being brought into frictional contact with said piston plate member of said actuator means under pressure of fluid supplied to said first fluid chamber.

12. A system as claimed in claim 11, further comprising means for controlling pressure of the fluid to be supplied to said first fluid chamber in response to a detected amount of a woven cloth wound on said cloth roller.

13. A system as claimed in claim 1, further comprising a carrier which is movable to come near the loom and including means for mechanically supporting a filled cloth roller and an empty cloth roller, means for mechanically transferring said filled cloth roller from the loom to said carrier, means for mechanically transferring said empty cloth roller from said carrier to said loom, and means for winding an end section of a cloth on said empty cloth roller.

14. A system as claimed in claim 13, wherein said filled cloth roller transferring means includes a first support arm which is pivotally connected to said carrier and movable toward the loom to transfer said filled cloth roller from the loom to said carrier; and said empty cloth roller transferring means includes a second support arm which is pivotally connected to said carrier and movable toward the loom to transfer said empty cloth roller from said carrier to the loom.

15. A system as claimed in claim 13, wherein said winding means includes a winding arm pivotally connected to said carrier and having means for retaining an end section of said woven cloth and winding it on said empty cloth roller mounted on the loom.

16. A system as claimed in claim 13, further comprising means for cutting a woven cloth in the loom at a position upstream of said filled cloth roller in a direction of movement of the woven cloth, before transferring of the filled roller from the loom to said carrier.

17. A system as claimed in claim 13, wherein said retaining means is mechanically operated to grasp the end section of the woven cloth.

18. A system as claimed in claim 15, wherein said retaining means is pneumatically operated to suck the end section of the woven cloth under vacuum.

19. A system as claimed in claim 13, further comprising means automatically controlling operation of said filled cloth roller transferring means, said empty cloth roller transferring means, and said winding means, in accordance with a weaving operation of the loom.

20. A system as in claim 1, wherein said means for rotatably driving comprises a hollow cylindrical member surrounding said first rotatably shaft and being rotatable about said axis of rotation of said first rotatable shaft, means for rotatably driving said cylindrical member in a timed relation to an operation of the loom, and means for selectively coupling said cylindrical member to said first rotatable shaft.

21. A system as in claim 20, wherein said means for coupling comprises a clutch pad secured to a flange of said rotatable member and a flange fixedly secured to a second end of said first rotatable shaft and adapted to selectively engage said clutch pad.

22. A system as in claim 20, further comprising a main shaft of said of loom, and wherein said means for rotatably driving said cylindrical member comprises a member connecting said main shaft to said cylindrical member.

23. A system for replacing a cloth roller for a loom with another one, said system comprising:

a first rotatable shaft whose axis is generally aligned with an axis of said cloth roller;

a first engaging member fixedly connected to a first end section of said first rotatable shaft, said first engaging member being coaxial with said first rotatable shaft and engageable with a first end section of said cloth roller;

actuator means for axially moving said first rotatable shaft so that said first engaging member is selectively engaged with and disengaged from said cloth roller first end section, said actuator means including a plate piston member fixedly secured to a second end section of said first rotatable shaft, said plate piston member defining first and second fluid chambers on the opposite sides thereof, said first and second fluid chambers being selectively supplied with a fluid;

a second rotatable shaft whose axis is generally aligned with the axis of said cloth roller, said second rotatable shaft being axially movable by said actuator means;

a second engaging member fixedly connected to a first end section of second rotatable shaft, said second engaging member being coaxial with said second rotatable shaft and engageable with a second end section of said cloth roller, said second engaging member being selectively engaged with an disengaged from said cloth roller second end section upon axial movement of said second rotatable shaft; and means for supporting said movable shaft relative to a frame of the loom so as to be rotatable and axially movable, said supporting means including an outer cylindrical member fixed to the loom frame, an inner cylindrical member coaxial with said outer cylindrical member, said rotatable shaft being movably disposed in a bore of said inner cylindrical member, and a roller bearing disposed between said inner and outer cylindrical members to allow said inner cylindrical member to rotate relative to said outer cylindrical member.

24. A system for replacing a cloth roller for a loom with another one, said system comprising:

a first rotatable shaft whose axis is generally aligned with an axis of said cloth roller;

a first engaging member fixedly connected to a first end section of said first rotatable shaft, said first engaging member being coaxial with said first rotatable shaft and engageable with a first end section of said cloth roller;

actuator means for axially moving said first rotatable shaft so that said first engaging member is selectively engaged with and disengaged from said cloth roller first end section;

a second rotatable shaft whose axis is generally aligned with the axis of said cloth roller, said second rotatable shaft being axially movable by said actuator means;

a second engaging member fixedly connected to a first end section of said second rotatable shaft, said second engaging member being coaxial with said second rotatable shaft and engageable with a second end section of said cloth roller, said second engaging member being selectively engaged with and disengaged from said cloth roller second end section upon axial movement of said second rotatable shaft;

a carrier which is moveable to come near the loom;

means for mechanically supporting a filled cloth roller and an empty cloth roller;

means for mechanically transferring said filled cloth roller from the loom to said carrier;

means for mechanically transferring said empty cloth roller from said carrier to said loom; and means for winding an end section of a cloth on said empty cloth roller.

* * * * *